US005285580A

United States Patent [19]

Christensen

[11] Patent Number: 5,285,580

[45] Date of Patent: Feb. 15, 1994

[54] TEMPLATE FOR MARKING ROUNDED CORNERS

[76] Inventor: Robert J. Christensen, 210 E. 1000 South, Brigham City, Utah 84302

[21] Appl. No.: 958,893

[22] Filed: Oct. 9, 1992

[51] Int. Cl.[5] ..... B43L 13/20

[52] U.S. Cl. ..... 33/565; 33/27.01; 33/474

[58] Field of Search ..... 33/562, 565, 27.01, 33/27.04, 429, 474, 481, 14, 566

[56] References Cited

U.S. PATENT DOCUMENTS

| | | | |
|---|---|---|---|
| D. 137,150 | 1/1944 | Riddell | 33/565 |
| 313,197 | 3/1885 | Gaylord | 33/562 |
| 513,665 | 1/1894 | Barberie | 33/474 |
| 720,824 | 2/1903 | Lieber | 33/566 |
| 1,838,607 | 12/1931 | Zerbel | 33/429 |
| 2,247,362 | 7/1941 | Dibble, Jr. | 33/474 |
| 2,382,250 | 8/1945 | Newell | 33/429 |
| 2,652,866 | 9/1953 | Drain | 33/562 |
| 3,104,467 | 9/1963 | Lloyd-Young | 33/562 |
| 3,156,984 | 11/1964 | Palmer | 33/562 |
| 4,837,939 | 6/1989 | Pullen | 33/562 |

*Primary Examiner*—Thomas B. Will

*Attorney, Agent, or Firm*—Thorpe, North & Western

[57] ABSTRACT

A device for making an arc of a predetermined radius at a square corner of a workpiece includes a positioning member having first and second edge members which are joined together at a right angle so that the positioning member may be seated against the square corner and an arc member extending across a portion of the right angle formed between the first and second edge members. The arc member is planar with the positioning member disposed on and extending from the arc member. The device may also include multiple positioning members and multiple arc members having different arc radii. A method of marking an arc of a predetermined radius at a square corner of a workpiece includes the steps of providing a device that has a positioning member having first and second edge members joined together at a right angle such that the positioning member may be seated against the square corner and an arc member extending across a portion of the right angle formed by the edge members, positioning the device such that the positioning member is in a seated position against the square corner and the arc member is disposed against the surface of the workpiece to be marked; and marking the arc on the surface of the workpiece by holding a marking implement against the arc member and, while moving the marking implement along the arcuate edge, pressing the marking implement against the workpiece to leave a mark.

10 Claims, 1 Drawing Sheet

TEMPLATE FOR MARKING ROUNDED CORNERS

BACKGROUND OF THE INVENTION

This invention relates to a device and a method for marking an arc of a predetermined radius at a square corner. More particularly, this invention relates to a device and a method for marking an arc of a predetermined radius at a square corner of a workpiece so that, by using the arc as a guide for where to make a cut, a rounded corner can be produced.

Carpenters, amateur woodworkers, hobbyists, and others are frequently faced with the task of cutting a workpiece to produce a rounded corner beginning with a workpiece that has a square corner. A person wanting to make a rounded corner usually draws an arc on the workpiece, with the arc serving as a guide for where the cut is to be made. Use of a compass is one of the most precise methods of marking an arc on the workpiece, provided the compass is a good one. Although accurate, it is time-consuming to determine the center of the radius for drawing the arc with a compass. This problem is compounded, of course, when a workpiece has several corners that will be rounded or when several workpieces each have a corner to be rounded. Each corner to be rounded must be individually marked by going through the process of determining the length of the radius, determining the center of the radius, and then drawing the arc. Thus, it is tedious to repeat the same process for each corner to be marked. Compasses are typically able to draw arcs of any size within a certain range. This flexibility can be a disadvantage, however, when arcs of certain standard sizes are used repeatedly. A compass also may leave a hole in the workpiece at the center of the radius. With some types of workpieces this hole can be removed or covered, for example by sanding a piece of wood. However, with some workpieces it would be impossible or impractical to remove or cover the hole. Even if the hole can be removed or covered, it requires time and effort to do so. Further, compasses can be expensive, easily damaged, and easily misplaced.

Another method for marking an arc on a square corner is to place a cylindrical or circular object having the desired radius on the workpiece such that the edges of the workpiece that form the square corner are tangential to the circular edge of the object. With the object thus aligned, an arc is drawn by moving a pencil, pen, nail, or other marking instrument along the edge of the object. Objects such as lids, jars, and cans are often used for such a purpose. However, it is inconvenient to search for an object having the desired radius every time such a mark needs to be drawn. It is also inconvenient to keep a supply of objects on hand for when they might be needed.

OBJECTS AND SUMMARY OF THE INVENTION

It is an object of the present invention to provide a convenient and inexpensive device and a method for drawing an arc with a desired radius at a square corner.

It is another object of the invention to provide a device and a method for repeatably drawing arcs of a desired radius.

It is a further object of the invention to provide a device and a method for drawing arcs with a plurality of standard radii.

It is still another object of the present invention to provide a device for drawing arcs that is durable.

These and other objects are realized in a device and a method for marking an arc of a predetermined radius at a square corner. The device includes a positioning member having first and second edge members that are joined together to form a right angle having an interior face configured for positioning against the square corner in a seated position, and an arc member extending across the right angle formed between the first and second edge members. The method includes providing the device just described, positioning the device such that the positioning member is seated against the square corner and the arc member is against the surface of the workpiece to be marked, and marking the arc on the surface of the workpiece by holding a marking implement against the arc member and, while moving the marking implement along the arcuate edge of the arc member, pressing the marking implement against the workpiece to leave a mark.

DETAILED DESCRIPTION OF THE INVENTION

The invention described herein is a device and a method for marking an arc of a predetermined radius at a square corner. The device is useful, for example, to a carpenter who typically marks an arc on a square corner as a guide for where to cut to remove excess material in making a rounded corner. The basic concept of the device includes a positioning member for positioning the device in a seated position against the square corner that is to be marked, and an arc member that is placed against the surface to be marked, when the positioning member is properly seated, to provide a template for marking the arc on the workpiece.

Figure 1:
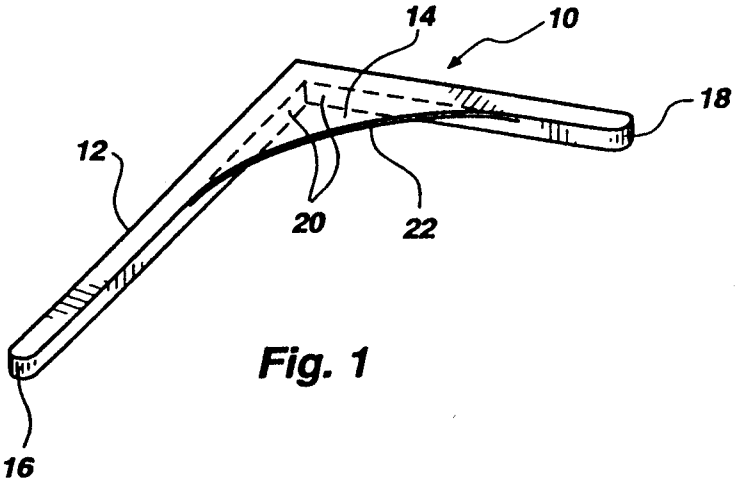
FIG. 1 is a perspective view of an embodiment of the present invention with the right angle formed between first and second edge members shown in phantom.

Reference is now made to the drawings wherein like components are designated by like numerals throughout. FIG. 1 shows an embodiment of the device 10 that contains one positioning member 12 and one arc member 14. The positioning member 12 includes a first edge member 16 and a second edge member 18 which are joined together at a right angle. The right angle has an interior face 20 which may be positioned against the square corner of the workpiece to seat the device 10. The arc member 14 extends across the right angle formed between the first edge member 16 and the second edge member 18. The arc member 14 is planar and has an arcuate edge 22. The positioning member 12 is disposed on the arc member 14 such that the positioning member 12 extends from the arc member 14. The arcuate edge is symmetrically disposed between the first edge member 16 and the second edge member 18. When the device 10 is seated against a square corner of a workpiece that is to be marked, the arc member 14 lays flat against the surface of the workpiece such that the plane of the arc member 14 and the plane of the workpiece surface are parallel. The arcuate edge 22 functions as a template for making the mark on the workpiece. With the device 10 in place, a marking implement is placed against the arcuate edge 22 and with simultaneous pressure against both the arcuate edge 22 and the workpiece, the marking implement is moved along the arcuate edge 22 to leave a mark on the workpiece.

Figure 2:
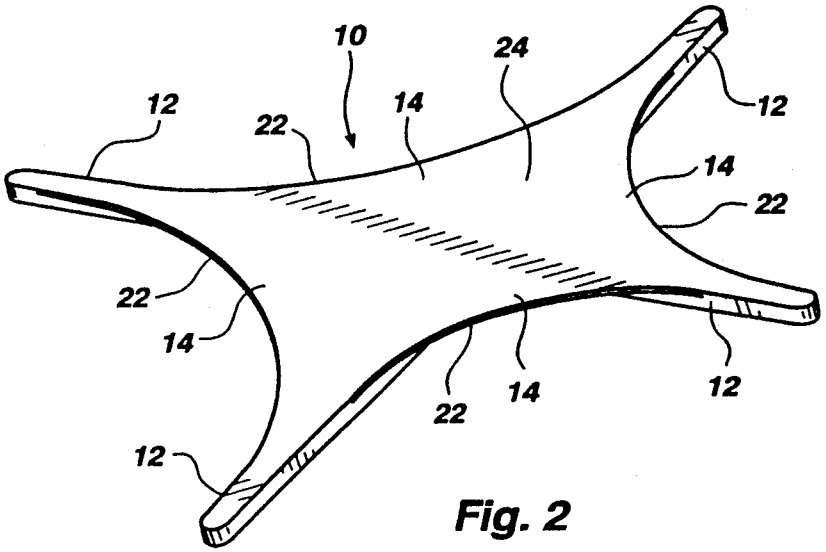
FIG. 2 is a perspective view of an embodiment of the invention having four positioning members and four arc members combined in one device.

Advantageously, a plurality of positioning members 12 and arc members 14 may be combined in another embodiment of the device 10. FIG. 2 displays a preferred embodiment of the device 10 that contains four positioning members 12 and four arc members 14. The embodiment of the device 10 shown in FIG. 2 can be thought of as a combination or fusion of four copies of the embodiment of the device depicted in FIG. 1. The advantage of making an embodiment of the device 10 with a plurality of positioning members 12 and arc members 14 is, of course, that different arc radii can be chosen for the different arcuate edges 22. Thus, as an example, arc radii of 3.0, 4.0, 5.0, and 6.0 inches, respectively, could be selected for an embodiment of the device 10 with four arcuate edges 22, such as is shown in FIG. 2. Although other configurations might be selected, and are considered within the scope of the invention, the preferred configuration entails combining the arc members 14 so that the arc members 14 are all in the same plane to form a planar arc plate 24. The positioning members 12 may also be fused together, as is shown in FIG. 2, or may be separate.

Figure 3:
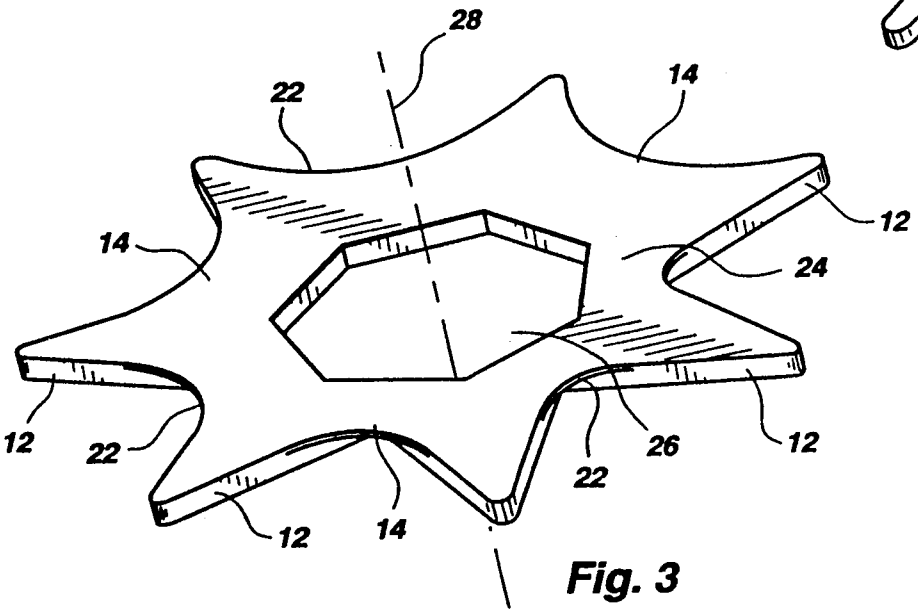
FIG. 3 is a perspective view of an embodiment of the invention having seven positioning members and seven arc members combined in a device having seven-fold symmetry.

Another preferred embodiment of the device 10 is depicted in FIG. 3. This embodiment contains seven sets of positioning members 12 and arc members 14. As in the embodiment shown in FIG. 2, this embodiment also has all the arc members 14 disposed on each other such that the arc members 14 form a planar arc plate 24. FIG. 3 also shows that the arc plate 24 may contain an opening 26, in this case located generally at the center of the arc plate 24. The opening 26 makes the device 10 easier to hold in a person's grasp and may be used for hanging the device 10 on a pegboard or on a nail in the wall for convenient storage. Advantageously, each of the arcuate edges 22 has a different arc radius. For example, arc radii of 0.5, 0.75, 1.0, 1.25, 1.5, 1.75, and 2.0 inches could be selected for an embodiment having seven arc members 14. The seven positioning members 12 and seven arc members 14 are radially arranged around a central perpendicular axis 28. The embodiment shown in FIG. 3 has the positioning members 12 arranged symmetrically about the perpendicular axis 28 to exhibit seven-fold symmetry. Other symmetrical and asymmetrical arrangements are also considered within the scope of the invention.

The device 10 needs to be rigid to maintain the right angles formed by the first and second edge members 16 and 18 formed as intersecting flanges and to maintain the radius defined by an arcuate edge 22. These edge members 16 and 18 may also be configured as two lines of projecting bumps which form two right angle edges, or of other forms which provide a blocking edge. It is also advantageous if the material from which the device 10 is fabricated is light in weight, inexpensive, and easy to handle. Thus, a preferred method of making the device 10 is by molding a polycarbonate plastic material such as LEXAN TM. However, the device 10 may be constructed of any suitable material, such as hard rubber, wood, or metal, without departing from the scope of the invention.

A method of drawing an arc of a predetermined radius at a square corner of a workpiece includes positioning the device 10 such that the interior face 20 of the positioning member 12 in a seated position against the square corner of the workpiece and so that the arc member 14 is disposed against the surface of the workpiece that is to be marked. Ideally the arc member 14 is disposed parallel to the plane of the workpiece so the arc member 14 is laying flat on the workpiece. With the device 10 properly positioned, a marking implement is held against the workpiece and simultaneously against the arcuate edge 22 of the arc member 14, and then the marking implement is moved along the arcuate edge 22, thus producing a mark on the surface of the workpiece.

It is to be understood that the above-described arrangements are only illustrative of the application of the principles of the present invention. Numerous other modifications and alternative arrangements may be devised by those skilled in the art without departing from the spirit and scope of the present invention and the appended claims are intended to cover such modifications and arrangements.

I claim:

1. A device for marking an arc of a predetermined radius at a square corner, said square corner having a face and free exterior edges such that the arc is marked upon the face when the device is asymptotically fitted to said exterior edges, the device comprising:

a plurality of positioning members, each positioning member including first and second edge members which form a right angle therebetween and which form an interior face configured for positioning against the exterior edges of the square corner in a seated position, and a main body plate connected to the positioning members to thereby form a plurality of three-sided receiving pockets, each receiving pocket for selectively receiving the square corner, the main body plate configured for placement against a portion of the face of the square corner in a seated position and further including:

a plurality of planar, interconnected concave arc members positioned such that each arc member extends across the right angle formed between one of said first and second edge members and is symmetrically disposed between said edge members, so that at least a portion of each edge member is non-planar with its corresponding arc member and forms a side wall of its corresponding receiving pocket, said edge members being disposed on and extending from said arc members, each arc member having a free concave arcuate edge extending between its corresponding edge members to provide a guide for marking an arc on the square corner.

2. The device as in claim 1 wherein the radii of the arcuate edges are of different lengths.

3. The device as in claim 2 wherein the arc members are disposed on each other to form a planar arc plate.

4. The device as in claim 3 wherein the arc members and positioning members are disposed radially around a central perpendicular axis.

5. The device as in claim 4 further comprising an opening in the arc plate.

6. The device as in claim 5 wherein the opening is generally centrally located in the arc plate.

7. The device as in claim 4 wherein the positioning members are symmetrically disposed around the central perpendicular axis.

8. The device as in claim 7 wherein the symmetry is four-fold symmetry and the arc radii have lengths of 3.0, 4.0, 5.0 and 6.0 inches.

9. The device as in claim 7 wherein the symmetry is seven-fold symmetry and the arc radii have lengths of 0.5, 0.75, 1.0, 1.25, 1.5, 1.75, and 2.0 inches.

10. The device as in claim 1 wherein the device is composed of a molded plastic material.

* * * * *